US007659856B2

(12) United States Patent
Chu et al.

(10) Patent No.: US 7,659,856 B2
(45) Date of Patent: Feb. 9, 2010

(54) EXTREMELY MINIATURIZED DIGITAL ANTENNA HAVING SWITCHABLE MULTIPLE BANDWIDTHS

(75) Inventors: Te-Yi Chu, Tainan Hsien (TW); Tsai-Yi Yang, Tainan Hsien (TW)

(73) Assignee: Cirocomm Technology Corp., Tainan (TW)

( * ) Notice: Subject to any disclaimer, the term of this patent is extended or adjusted under 35 U.S.C. 154(b) by 459 days.

(21) Appl. No.: 11/746,151

(22) Filed: May 9, 2007

(65) Prior Publication Data

US 2008/0278392 A1 Nov. 13, 2008

(51) Int. Cl.
*H01Q 1/24* (2006.01)
*H01Q 9/00* (2006.01)
*H01Q 3/24* (2006.01)

(52) U.S. Cl. ..... 343/702; 343/745; 343/876

(58) Field of Classification Search ..... 343/700 MS, 343/702, 745, 876, 895
See application file for complete search history.

(56) References Cited

U.S. PATENT DOCUMENTS 7,129,894 B1 * 10/2006 Winter ..... 343/700 MS
2006/0214857 A1 * 9/2006 Ollikainen ..... 343/702

FOREIGN PATENT DOCUMENTS

| | | |
|---|---|---|
| TW | M277120 | 10/2005 |
| TW | M279994 | 11/2005 |
| TW | M284146 | 12/2005 |
| TW | M286443 | 1/2006 |

* cited by examiner

*Primary Examiner*—Shih-Chao Chen
(74) *Attorney, Agent, or Firm*—Chun-Ming Shih

(57) ABSTRACT

An extremely miniaturized digital TV signal reception antenna built in a mobile device includes a substrate, an antenna unit and a switch unit. The substrate is provided with a plate having a grounding metallic surface and a first clearance surface. A second clearance surface is provided on the same side of the grounding metallic surface with a metallic microstrip line for electrically connecting to an output end of the switch unit. Input ends of the switch unit are electrically connected with a plurality of leads of the first clearance surface. The other ends of the plurality of leads are electrically connected with the antenna unit. Finally, when a tuner of a portable digital television switches the channels, signals of the switched channel are simultaneously output to the switch unit. According to the frequency of that channel, the switch unit automatically switches to a suitable range of bandwidth for receiving the digital TV signals, thereby performing the reception of the digital TV signals.

10 Claims, 13 Drawing Sheets

| First control pin | Second control pin | Third control pin | First input pin | Second input pin | Third input pin |
|---|---|---|---|---|---|
| HIGH | LOW | LOW | ON | OFF | OFF |
| LOW | HIGH | LOW | OFF | ON | OFF |
| LOW | LOW | HIGH | OFF | OFF | ON |

EXTREMELY MINIATURIZED DIGITAL ANTENNA HAVING SWITCHABLE MULTIPLE BANDWIDTHS

BACKGROUND OF THE INVENTION

1. Field of the Invention

The present invention relates to a digital TV antenna and in particular to a digital TV antenna structure having switchable multiple bandwidths.

2. Description of Prior Art

Conventionally, picture signals of a common household television (referred to as an analog TV) changes continuously and adopts a NTSC system. On the contrary, in a digital television, the picture signals are subjected to a digital processing to become a series of data. Then, the thus-formed data are subjected to a digital modulation and transmitted to a digital box or a digital television in the house, so that digital television programs can be watched.

The progress of video compression technology facilitates the success in the digital television. The current international standard of compression is MPEG-2. In the television channels of a conventional wireless television having a bandwidth of 6 MHz, 1080 horizontally scanning lines can be transmitted. Such a high definition television is referred to as a HDTV. In comparison with the traditional television having 525 scanning lines, the picture of the HDTV is fine and delicate, and the color thereof is vivid. Further, the HDTV can provide a stereo, high-class Dolby AC3 audio effect.

In recent years, with the continuous progress of technology, many electronic products tend to be light and compact whereby a user can carry them to the outside very easily. Therefore, the volume of the digital television is also reduced to become a portable mobile digital television. As a result, the user can carry it to the outside or mount it in a car. When using a portable digital television to watch programs, it is necessary for the user to connect an external antenna to the housing of the digital television. With this antenna receiving signals, the user can watch digital television programs in a car or in the outside. In order to increase the range of frequency bandwidth that can be received by the digital television, the dimension of the digital TV antenna is always made larger, such as those disclosed in Taiwan Patent Publications No. M277120 (FIG. 1), No. M279994 (FIG. 2), No. M284146 (FIG. 3) and No. M286443 (FIG. 4). As a result, the digital antenna can be only connected externally to the digital television but cannot be built in the portable digital television. Therefore, it is very inconvenient for the user to carry such a large digital antenna.

SUMMARY OF THE INVENTION

Therefore, the object of the present invention is to provide an extremely miniaturized digital antenna that can be built in a portable digital television. Since the wavelength and the frequency of the electromagnetic wave are reversely proportional to each other, the same one antenna can be separated into a plurality of frequency bands. In this way, when the antenna switches the channels via a frequency toner of the digital television, a range of frequency suitable for reception can be also obtained, so that even a small-sized antenna can achieve an operation of wide bandwidth system.

In order to achieve the above objects, the present invention provides an extremely digital reception antenna having a multiple switchable bandwidth, which comprises a substrate, an antenna unit and a switch unit.

The substrate is provided with a plate having a grounding metallic surface and a first clearance surface. On the same side of the grounding metallic surface, a second clearance surface is provided for allowing the surface of the substrate to be exposed to the outside. The second clearance surface has a metallic microstrip line thereon. The first clearance surface has a plurality of leads and contacts thereon.

The antenna unit is made into an elongated cubic carrier by materials having a high dielectric constant (K>4). Both ends of the carrier are covered with a first electrode and a second electrode, respectively. A lead is electrically connected between the first and second electrodes for covering the surface of the carrier. The first and second electrodes of the antenna unit are electrically connected with any lead and contact on the first clearance surface. The other two leads of the first clearance surface are electrically connected with the lead of the antenna unit.

The interior of the switch unit is provided with a plurality of grounding terminals, N controlling ends, N inputting ends, N switches and an outputting end ($N \geqq 2$). The controlling end is electrically connected with a frequency tuner of the digital television. The inputting end is electrically connected with the plurality of leads of the first clearance surface. Inputting pins of the N switches are electrically connected with the inputting end, and outputting pins thereof are electrically connected with the outputting end.

DETAILED DESCRIPTION OF THE INVENTION

The technical contents and the detailed explanation of the present invention are described with reference to the accompanying drawings.

Figure 1:
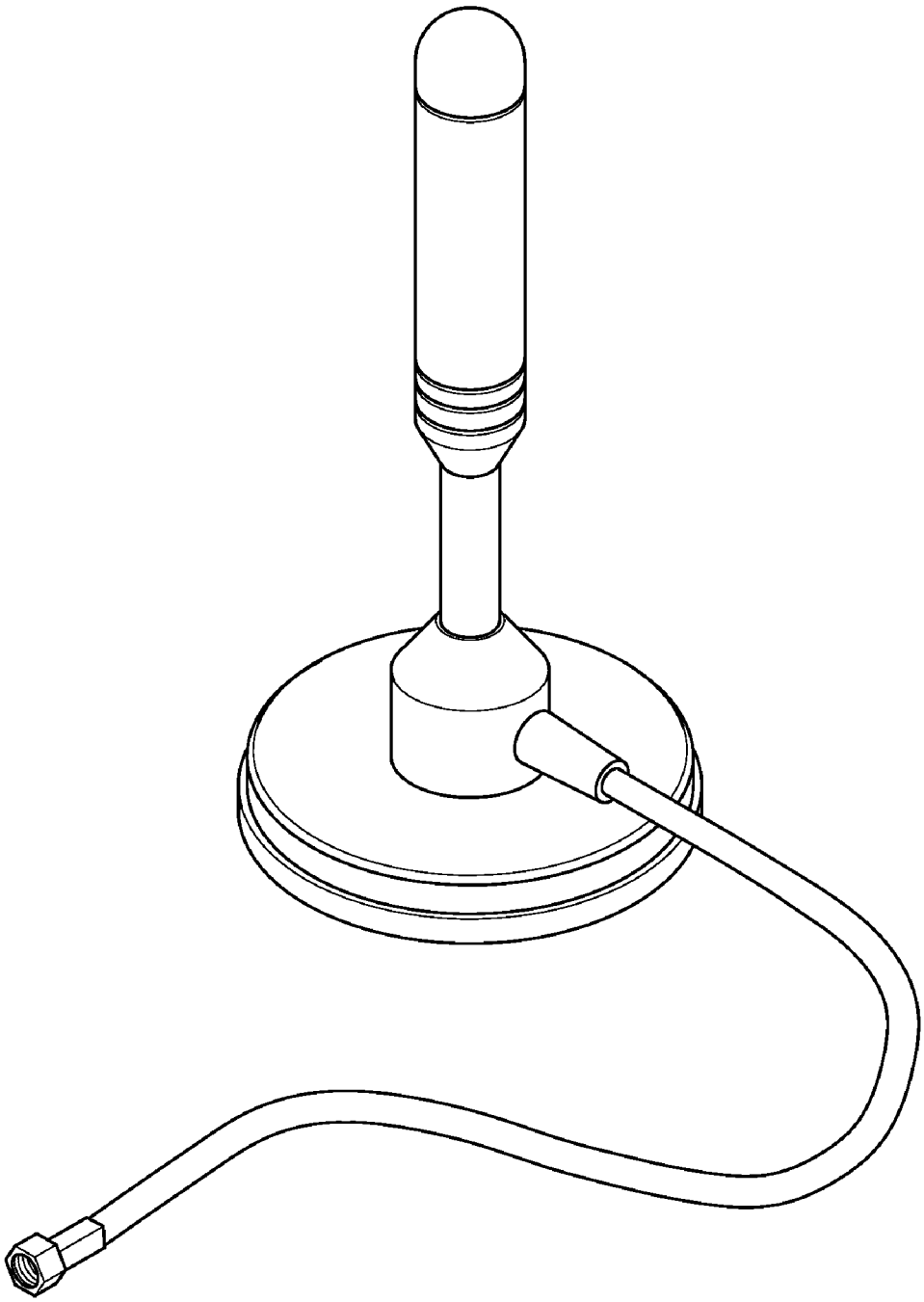
FIG.1 (Prior Art)
FIG. 1 is a schematic view showing the external appearance of a conventional digital TV antenna used in a car.
Figure 2:
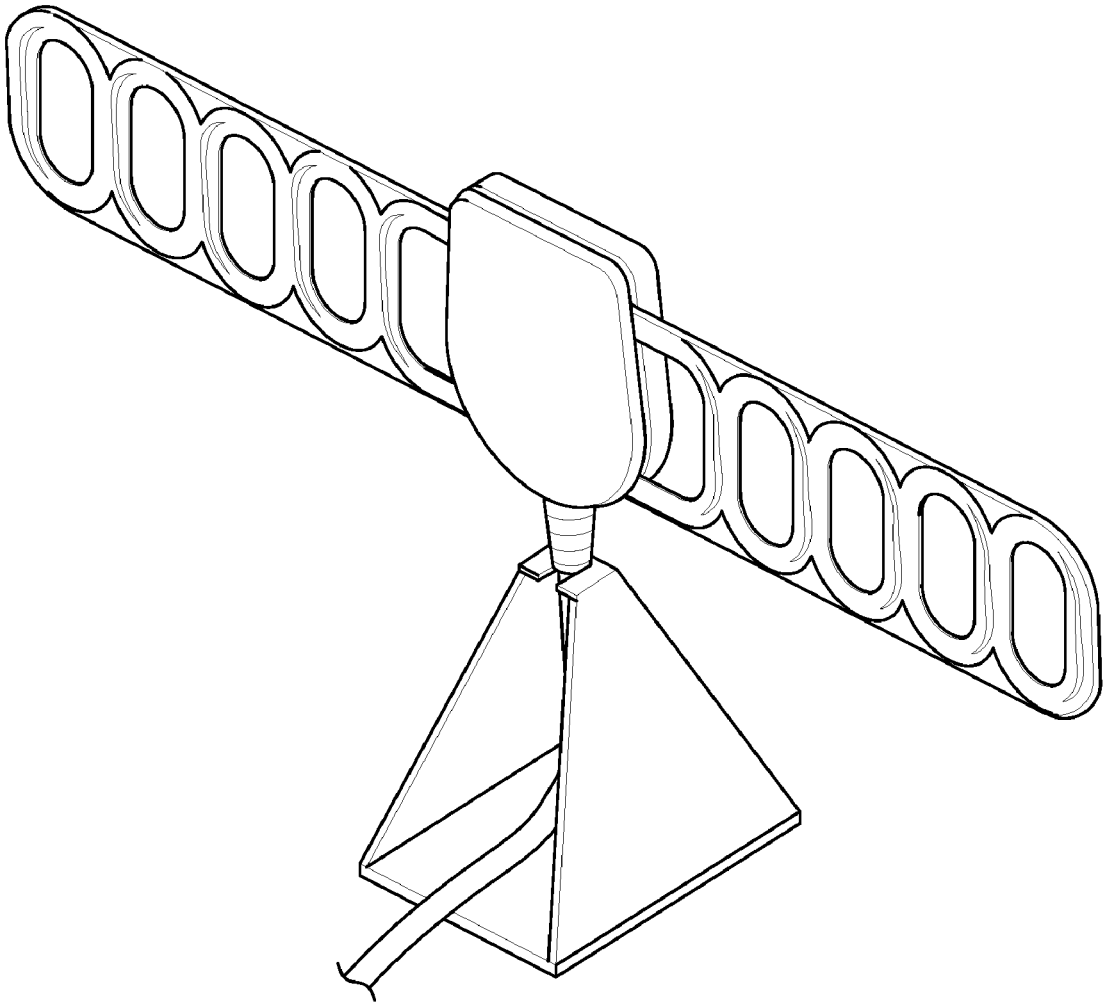
FIG.2 (Prior Art)
FIG. 2 is a schematic view showing the external appearance of another conventional digital antenna used in a car.
Figure 3:
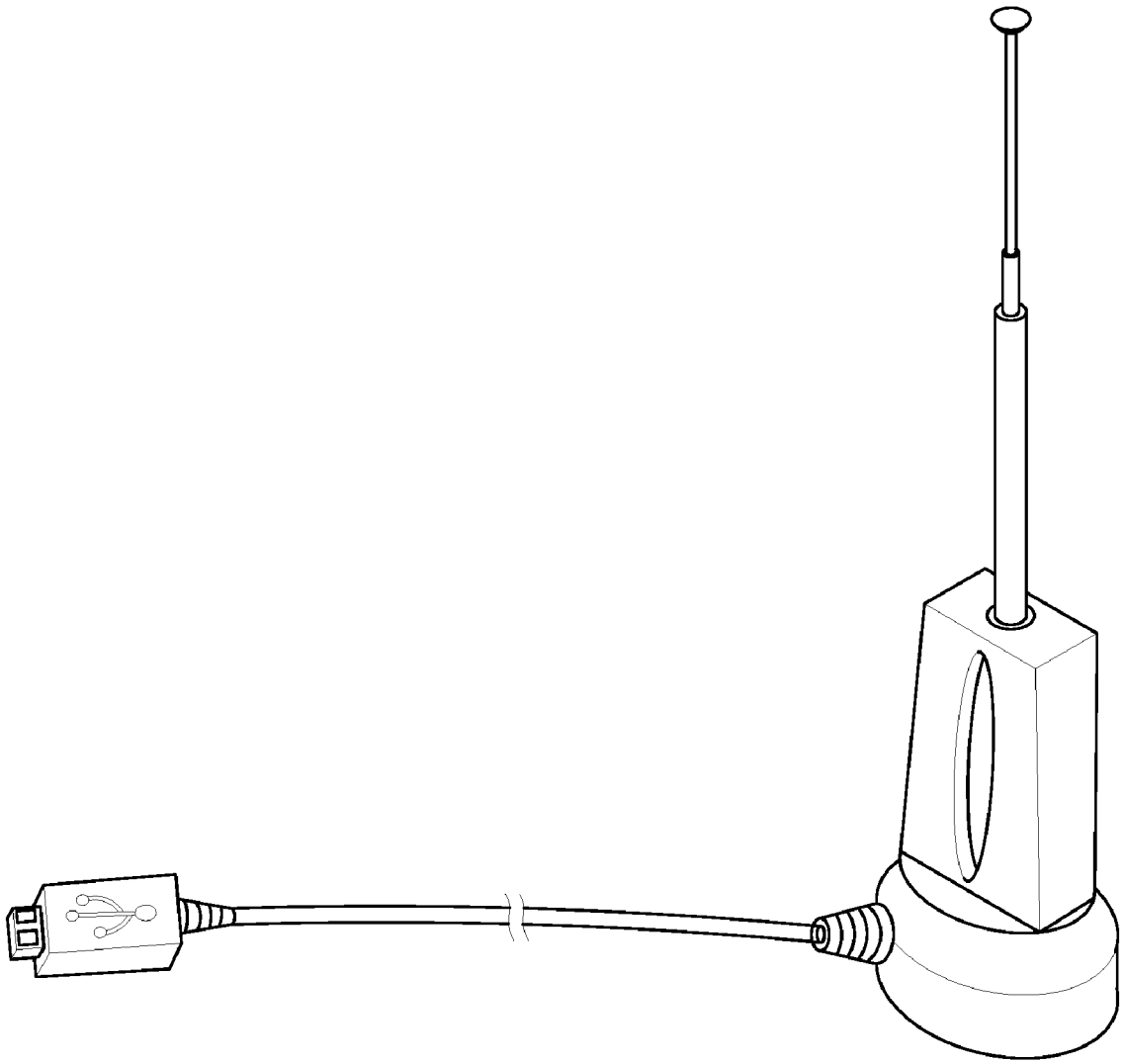
FIG.3 (Prior Art)
FIG. 3 is a schematic view showing the external appearance of a conventional digital antenna having a USB interference.
Figure 4:
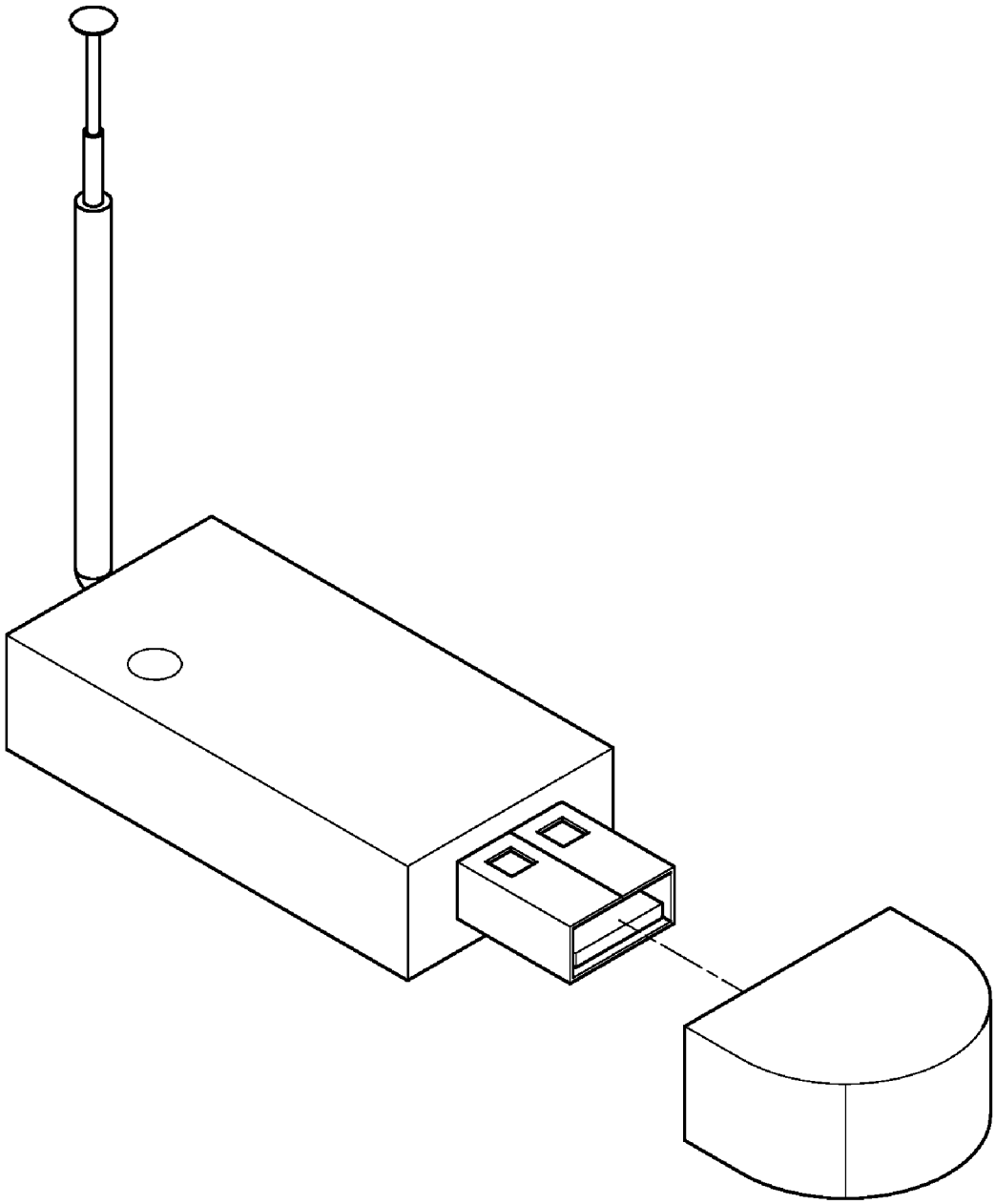
FIG.4 (Prior Art)
FIG. 4 is a schematic view showing the external appearance of a conventional flash disk having a digital TV antenna.
Figure 5:
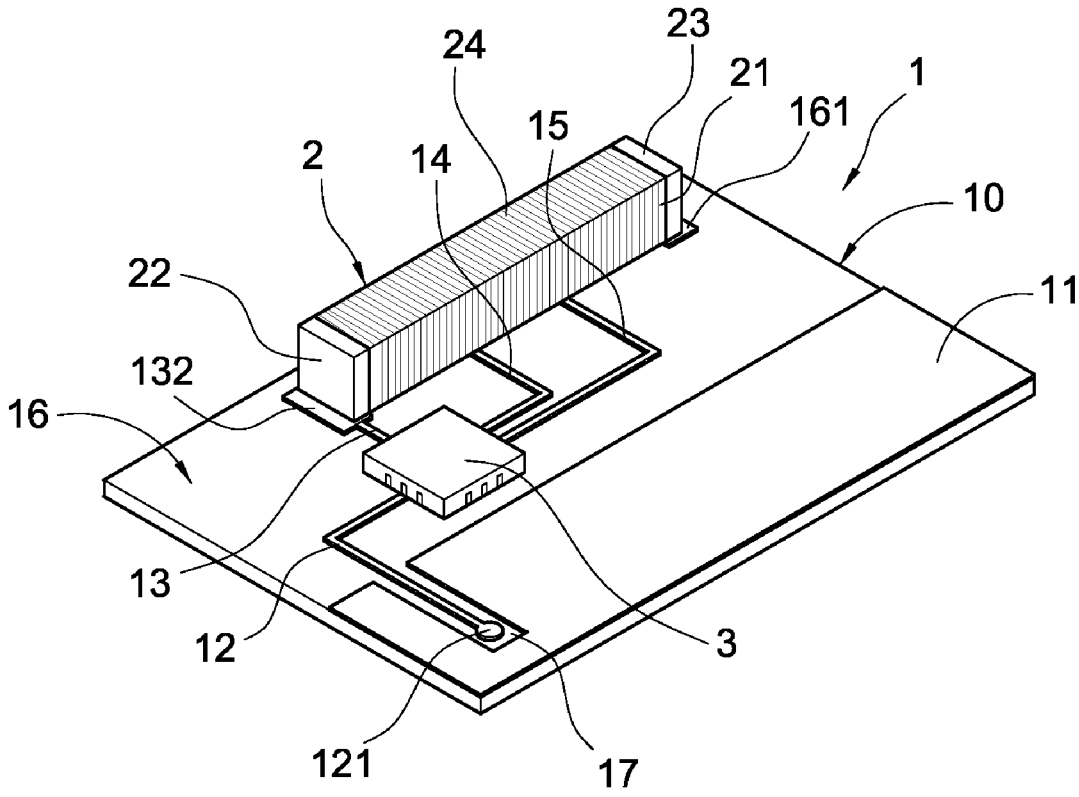
FIG. 5 is a schematic view showing the external appearance of the digital antenna of the present invention.

With reference to FIG. 5, it is a schematic view showing the external appearance of the digital TV antenna of the present invention. As shown in this figure, the present invention is directed to an extremely miniaturized digital TV signal reception antenna structure having switchable multiple bandwidths, which is a digital TV antenna built in a portable compact digital television device. The antenna includes a substrate 1, an antenna unit 2 electrically connected on the substrate 1, and a switch unit 3 electrically connected with the substrate 1 and the antenna unit 2. The substrate 1 is formed with a grounding metallic surface 11. On one side of the grounding metallic surface 11, the substrate 1 is formed thereon with a metallic microstrip line 12 that is used as a signal input point. One end of the metallic microstrip line 12 is electrically connected with the switch unit 3. The switch unit 3 is electrically connected with a first lead 13, a second lead 14 and a third lead 15, respectively. The other ends of the first lead 13, the second lead 14 and the third lead 15 are electrically connected with the antenna unit 2, so that the antenna unit 2 forms an antenna having switchable multiple bandwidths. The switch unit 3 is driven by the signals output when an external tuner (not shown) switches channels, thereby switching the frequency band of the antenna unit 2. Therefore, the portable digital television can receive the digital TV signals of various frequency bands and thus the digital television programs can be watched.

Figure 6:
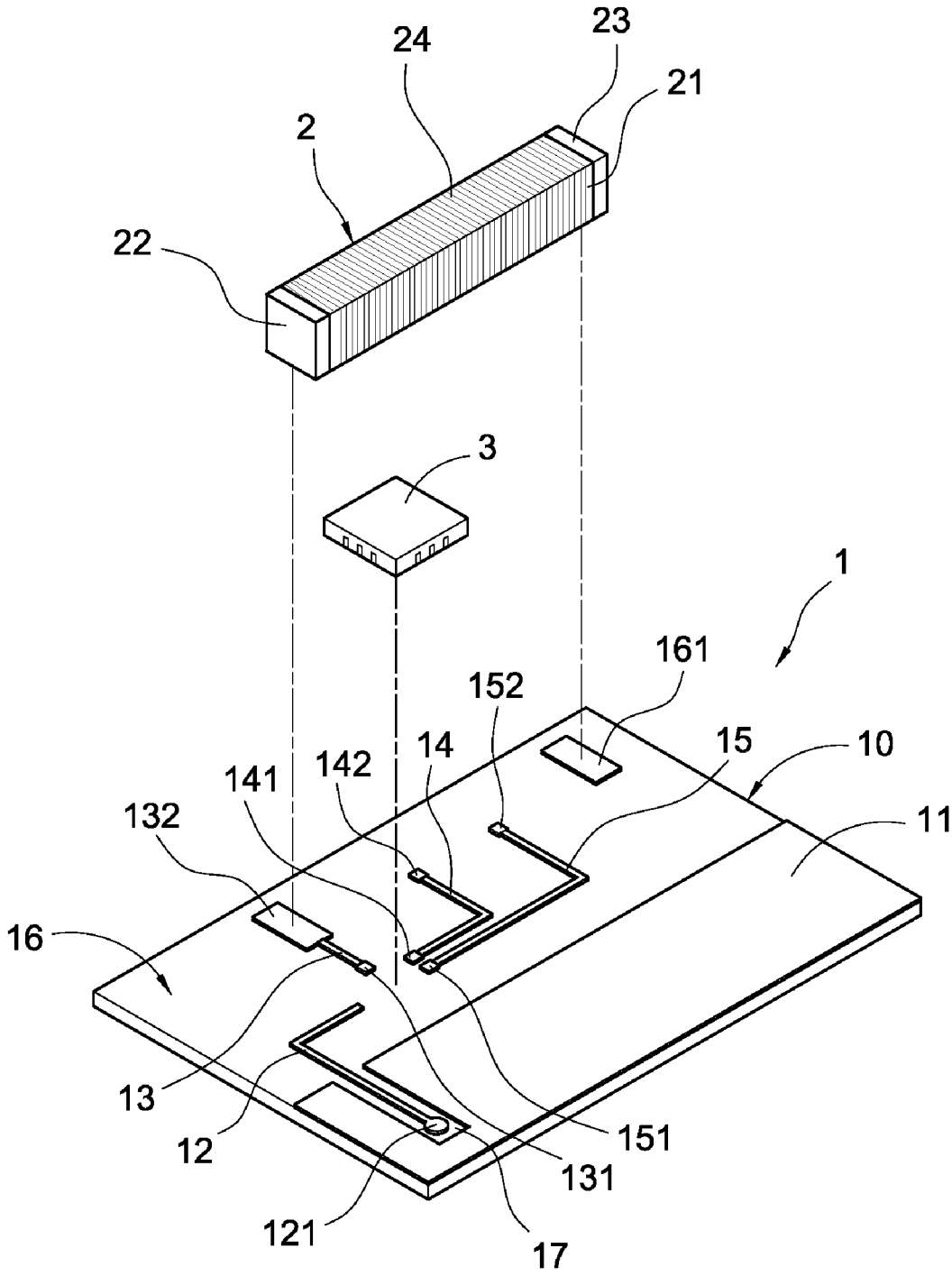
FIG. 6 is an exploded view showing the structure of the digital antenna of the present invention.
Figure 7:
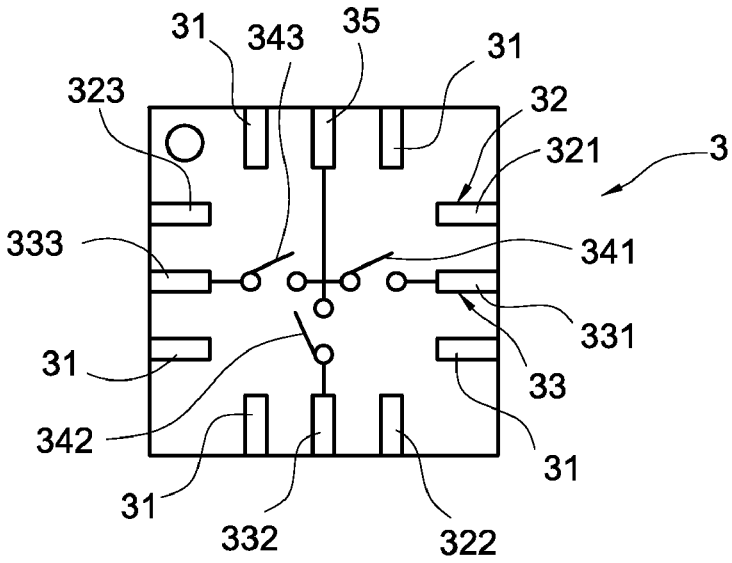
FIG. 7 is a schematic view showing the circuit within the switch unit of the present invention.

FIG. 6 is an exploded schematic view showing the structure of the digital TV antenna of the present invention, and FIG. 7 is a schematic view showing the circuit within the switch unit of the present invention. As shown in these figures, the substrate 1 has a plate 10 that is formed with a grounding metallic surface 11 and a first clearance surface 16 thereon. An U-shaped second clearance surface 17 is provided on the same side of the grounding metallic surface 11 for allowing the surface of the substrate 1 to be exposed. The second clearance surface 17 is formed thereon with a metallic microstrip line 12. One end of the metallic microstrip line 12 extends to a bottom end of the second clearance surface 17 and has a first contact 121. The first contact 121 is electrically connected with a lead or a coaxial lead column, thereby forming a signal input point. Via this arrangement, signals can be transmitted to a circuit board of a mobile device (not shown). The other end of the microstrip line 12 is electrically connected with an output end 35 of the switch unit 3. An input end 33 of the switch unit 3 is electrically connected with the contacts 131, 141, 151 of the first, second and third leads 13, 14, 15 on the first clearance surface 16, respectively. Each of the other ends of the first, second and third leads 13, 14, 15 has a contact 132, 142, 152. Further, the first clearance surface 16 has another contact 161 adjacent to the contact 152.

The antenna unit 2 is made into an elongated cubic carrier 21 by a ceramic material having a high dielectric constant ($K \geqq 4$). Both ends of the carrier 21 are covered with a first electrode 22 and a second electrode 23, respectively. A helical continuous conductor 24 is electrically connected between the first electrode 22 and the second electrode 23 for covering the surface of the carrier 21. When the antenna unit 2 is electrically connected with the substrate 1, the first electrode 22 and the second electrode 23 of the antenna unit 2 are electrically connected with the contacts 132, 161, while the contacts 142, 152 are electrically connected with the conductor 24 of the antenna unit.

With reference to FIG. 7, the switch unit 3 (for example, N=3) has a plurality of grounding ends 31, three control ends 32, three input ends 33, three small switches 34 and an output end 35. However, the number of the grounding ends, control ends, input ends and switches can be varied based on the number of the frequency bands separated by the antenna unit 2. First, second and third control pins 321, 322, 323 of the control end 32 are electrically connected with a tuner (not shown) of a digital television. The first input pin 331 of the input end 33 is electrically connected with the contact 131 of the first lead 13. The second input pin 332 is electrically connected with the contact 141 of the second lead 14. The third input pin 333 is electrically connected with the contact 151 of the third lead 15. The first switch 341 is electrically connected with the first input pin 331 and the output end 35. The second switch 342 is electrically connected with the second input pin 332 and the output end 35. The third switch 343 is electrically connected with the third input pin 333 and the output end 35. The out end 35 is electrically connected with the metallic microstrip line 12.

Figure 8:
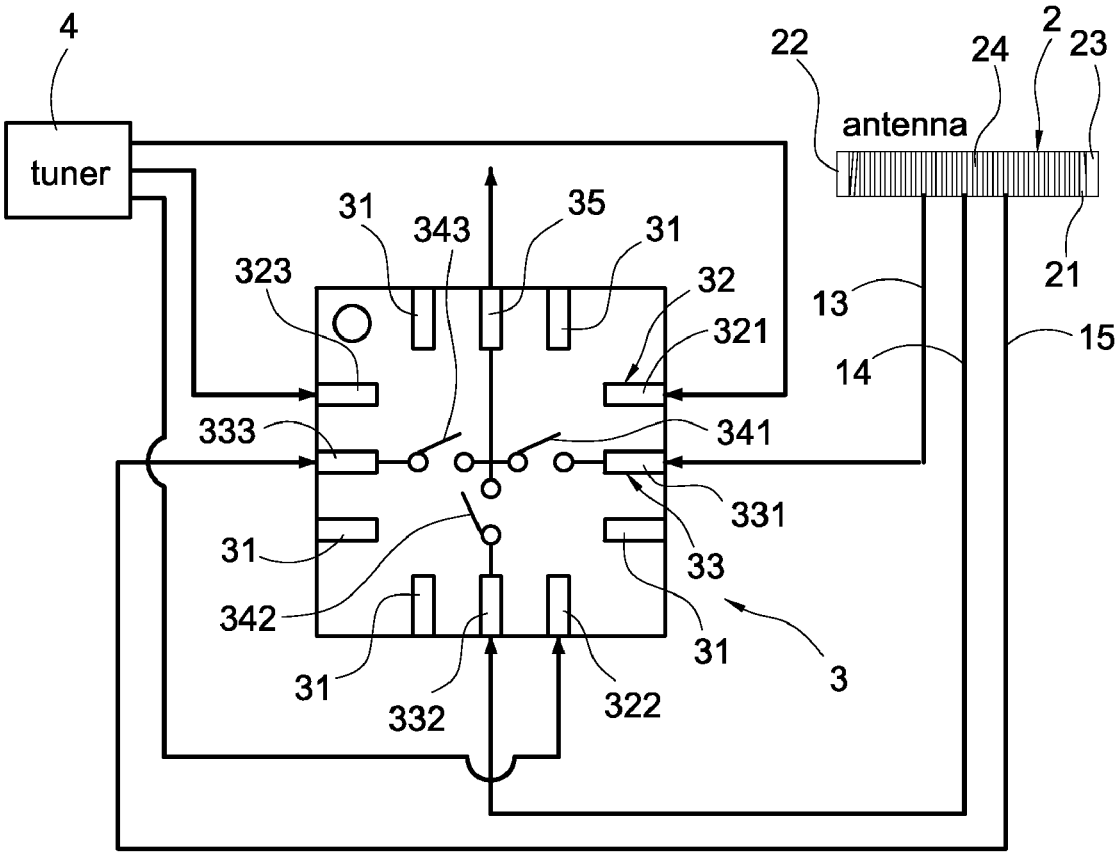
FIG. 8 is a block view showing the bandwidth control circuit of the digital antenna of the present invention.
Figures 9, 10:
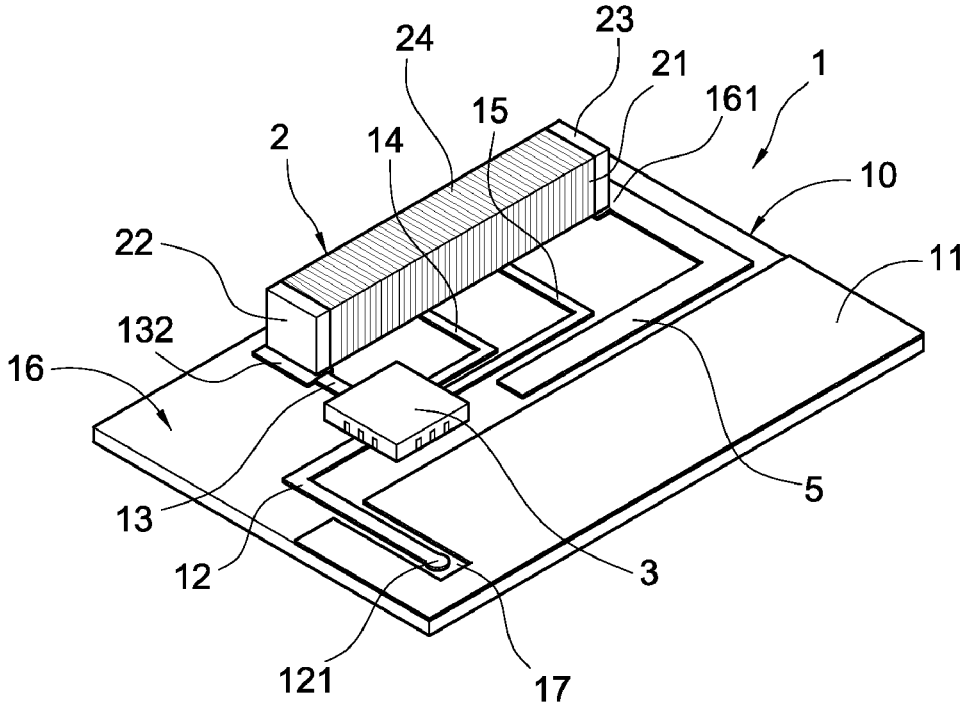
FIG. 9 is a schematic view showing the real value of the present invention.
FIG. 10 is a schematic view showing another embodiment of the present invention.

FIG. 8 is a block view showing the bandwidth control switch circuit of the digital antenna of the present invention, and FIG. 9 is a schematic view showing the real value of the present invention. As shown in these figures, first of all, it is assumed that the bandwidth of the antenna unit 2 is separated into a first bandwidth 450-550 MHz, a second bandwidth 550-650 MHz, and a third bandwidth 650-750 MHz. When a user presses a tuner 4 of the digital television to choose program channels, if the bandwidth of that selected channel is in the range of 450-550 MHz, the signals output by the tuner 4 is input from the first control pin 321. At this time, the first control pin 321 is in a state of "HIGH", so as to turn on the first switch 341. The digital TV signals received by the antenna unit 2 will be output by the first lead 13, through the first input pin 331, the first switch 341 and the output end 35. Then, the digital TV signals are transmitted via the metallic microstrip line 12 to the circuit board of the digital television and then are processed therein. In this way, the user can watch the digital television programs within the range of the bandwidth on the digital television.

When the bandwidth of the channel of the tuner 4 is switched to fall into the range of 550-650 MHz, the signals output by the tuner 4 is input from the second control pin 322. At this time, the second control pin 322 is in a state of "HIGH", so as to turn on the second switch 342. The digital TV signals received by the antenna unit 2 will be output by the second lead 14, through the second input pin 332, the second switch 342 and the output end 35. Since the length of the used antenna unit 2 is reduced and the wavelength is reversely proportional to the frequency, the frequency increases. Then, the digital TV signals are transmitted via the metallic microstrip line 12 to the circuit board of the digital television and are processed therein. At this time, the system can receive the digital television signals within the range of this bandwidth.

When the bandwidth of the channel of the tuner 4 is switched to fall into the range of 650-750 MHz, the signals output by the tuner 4 is input from the third control pin 323. At this time, the third control pin 323 is in a state of "HIGH", so as to turn on the third switch 343. The digital TV signals received by the antenna unit 2 will be output by the third lead 15, through the third input pin 333, the third switch 343 and the output end 35. Since the length of the used antenna unit 2 is reduced and the wavelength is reversely proportional to the frequency, the frequency increases. Then, the digital TV signals are transmitted via the metallic microstrip line 12 to the circuit board of the digital television and are processed therein. At this time, the system can receive the digital television signals within the range of this bandwidth.

With reference to FIG. 10, it is a schematic view showing another embodiment of the present invention. As shown in this figure, a metallic piece 5 having a larger area extends from the distal end of the contact 161 of the substrate 1 based on the environmental conditions, thereby increasing the radiation gain. Furthermore, the width or length of the metallic piece 5 can be adjusted so as to adjust or improve the radiation efficiency and impedance match.

Figure 11:
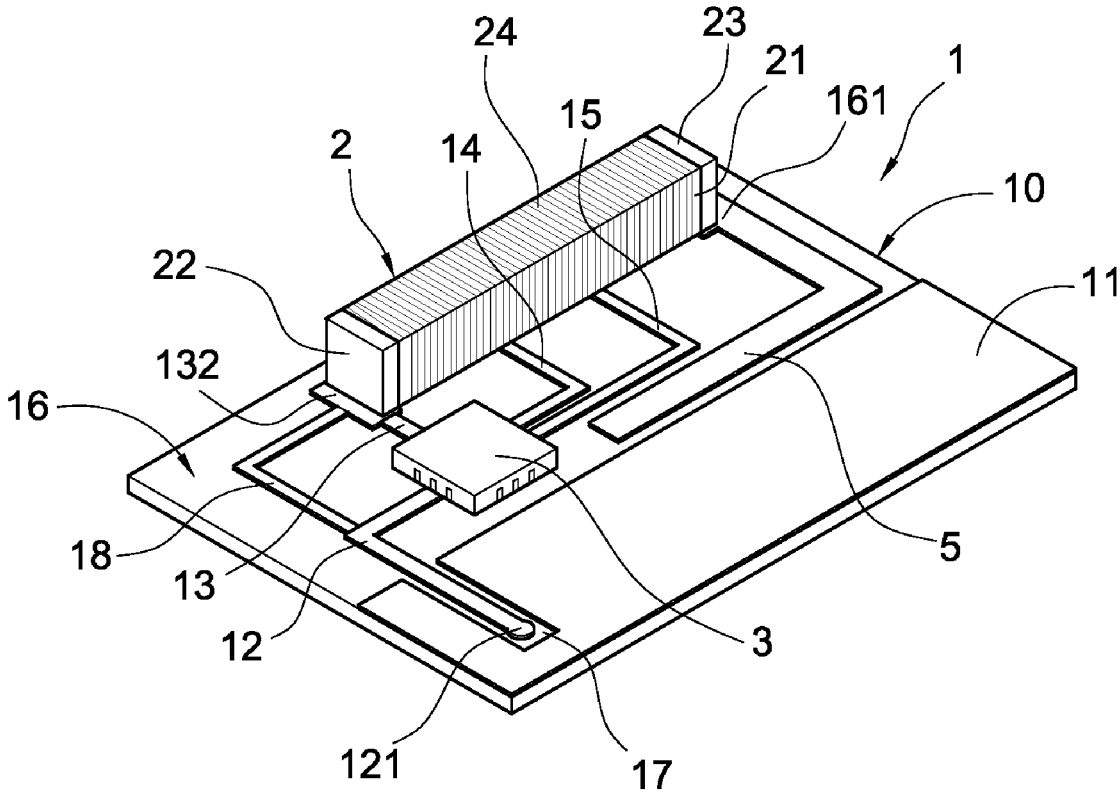
FIG. 11 is a schematic view showing a further embodiment of the present invention.
Figure 12:
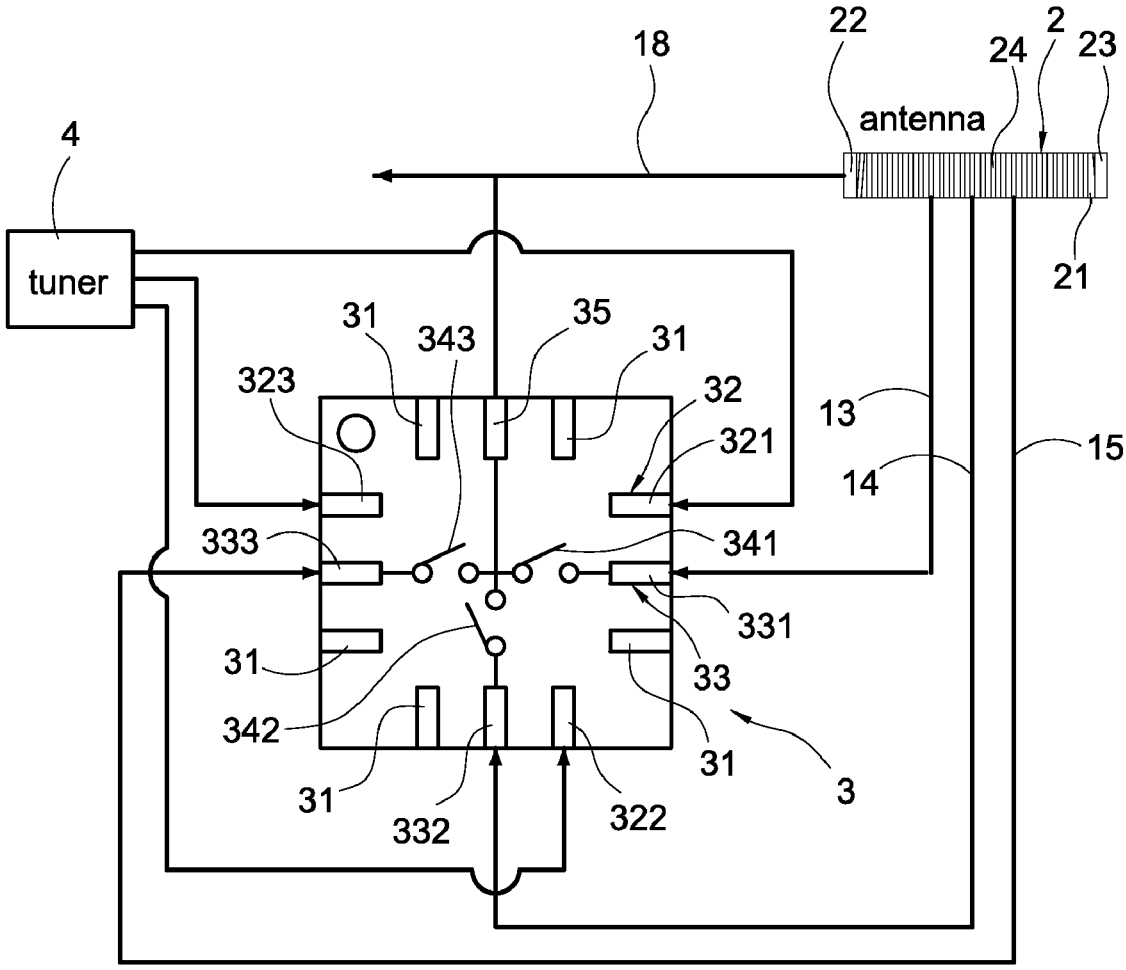
FIG. 12 is a schematic view showing the circuit of FIG. 11.

FIG. 11 is a schematic view showing a further embodiment of the present invention, and FIG. 12 is a schematic view showing the circuit of FIG. 11. As shown in these figures, a fourth lead 18 is additionally provided on the substrate 1 of the present invention for electrically connecting with the first electrode 22 of the antenna unit 2. The other end of the fourth lead 18 is not electrically connected with the switch unit 3 but is electrically connected with the metallic microstrip line 12.

When the switch unit 3 is not activated, the range of the bandwidth received by the antenna unit 2 is much smaller than the range of the digital TV signal bandwidth input into the first lead 13. Further, the signals received by the antenna unit 2 are output directly by the first electrode 22 and are transmitted via the fourth lead 18 to the metallic microstrip line 12. Then, the digital TV signals are transmitted via the metallic microstrip line 12 to the circuit board 8 of the digital television and are processed therein, so that the user can watch the digital television programs.

Figure 13:
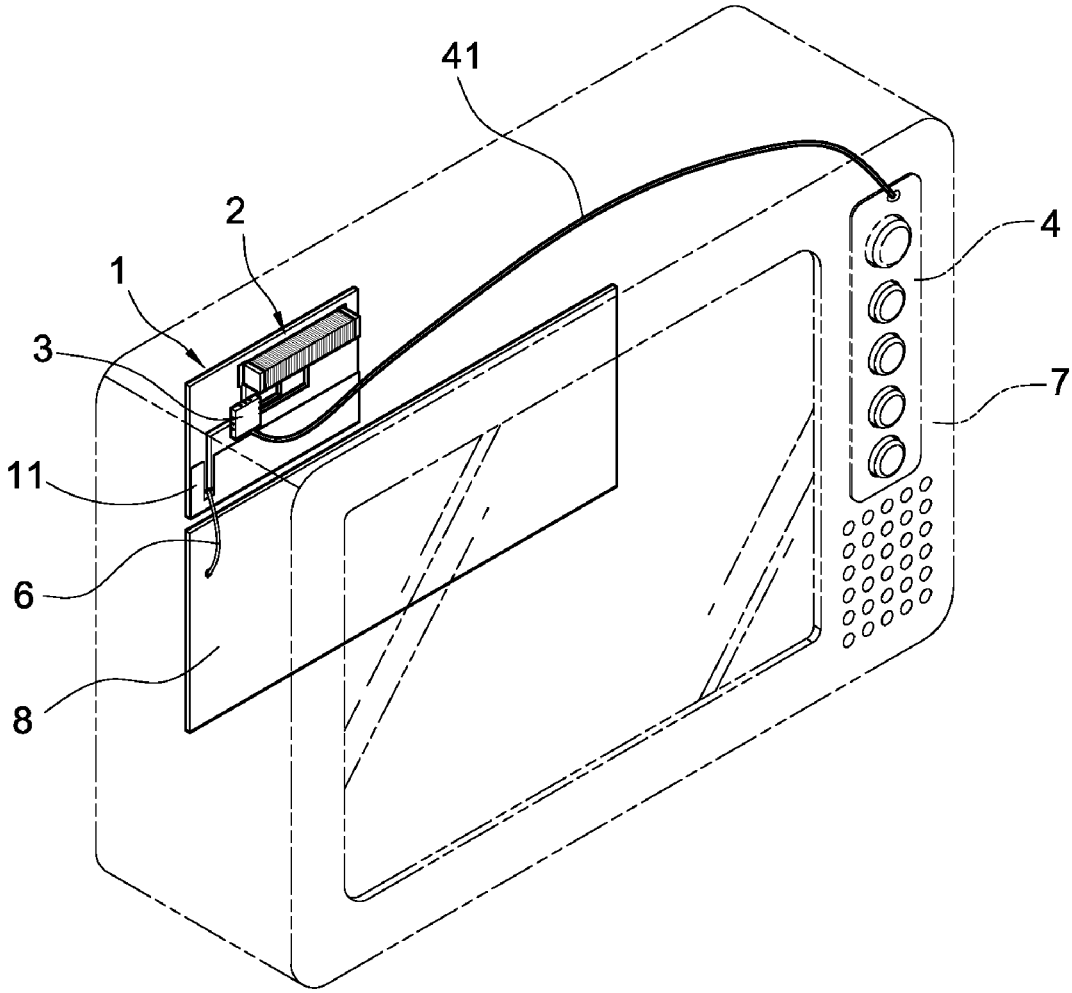
FIG. 13 is a schematic view showing a further embodiment of the present invention.

With reference to FIG. 13, it is a schematic view showing a further embodiment of the present invention. As shown in this figure, when the digital antenna of the present invention is built in a portable digital television 7, a lead 41 electrically connected to the tuner 4 of the digital television device is electrically connected with a plurality of control ends of the switch unit. A lead 6 connected to the metallic microstrip line of the substrate 1 is electrically connected with the main circuit board 8 of the digital television 7. When the tuner 4 switches the channels, it outputs a signal to any control end of the switch unit 3. The received digital TV signal is input from the input end of that control end, and then is output from that output end to the metallic microstrip line 12. Therefore, the digital TV signal is transmitted to the main circuit board 8 of the digital television 7 and is processed therein, so that the user can watch the digital television programs.

Figure 14:
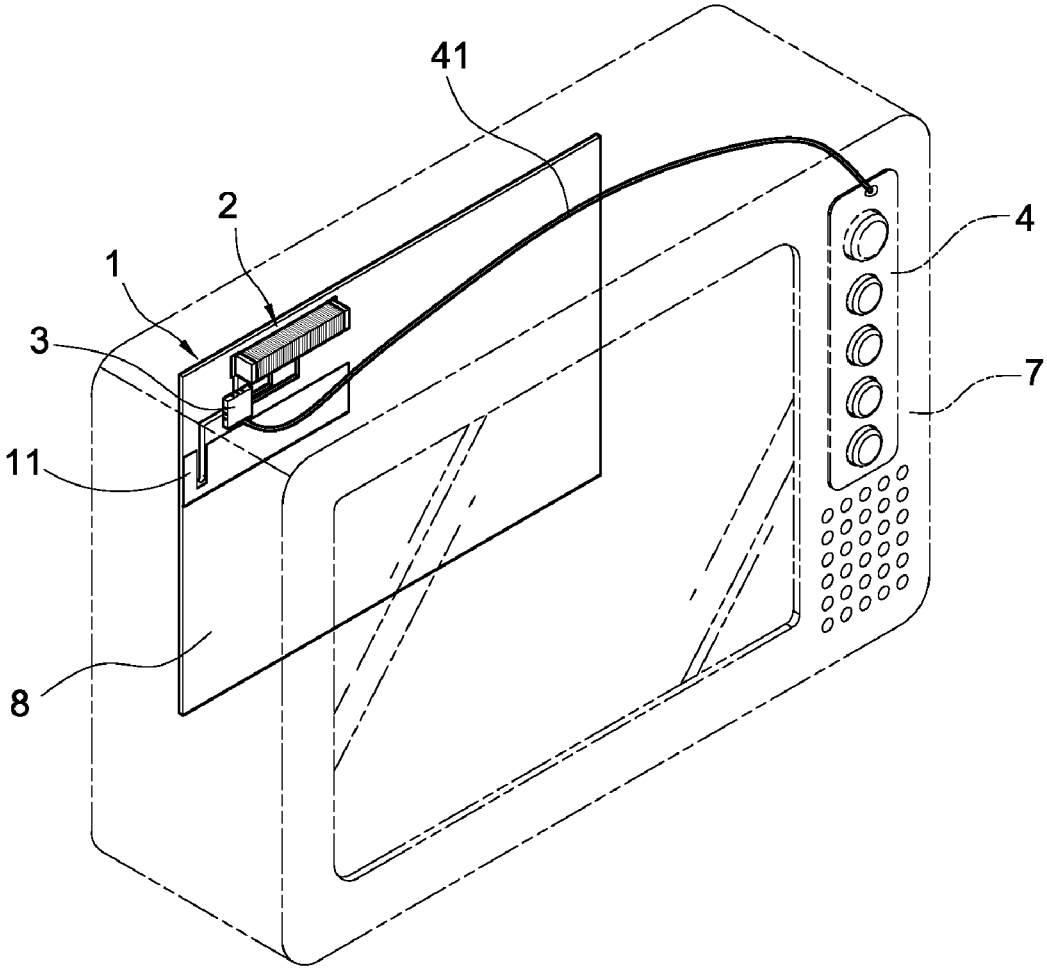
FIG. 14 is a schematic view showing a further embodiment of the present invention.

With reference to FIG. 14, it is a schematic view showing a further embodiment of the present invention. As shown in this figure, the substrate 1 of the digital reception antenna of the present invention and the main circuit board 8 of the digital television 7 can be the same substrate. During the manufacturing of the main circuit board 8 of the digital television 7, the grounding metallic surface 11, the metallic microstrip line 12, the first lead 13, the second lead 14, the third lead 15 and the fourth lead 18 of the substrate 1 can be directly made on the main circuit board 8. The antenna unit 2 and the switch unit 3 are electrically connected on the main circuit board 8 directly. After the antenna unit 2 receives the signals, the metallic microstrip line 12 transmits the signals to the circuit of the main circuit board 8. In this way, FM broadcast programs can be received.

Figure 15:
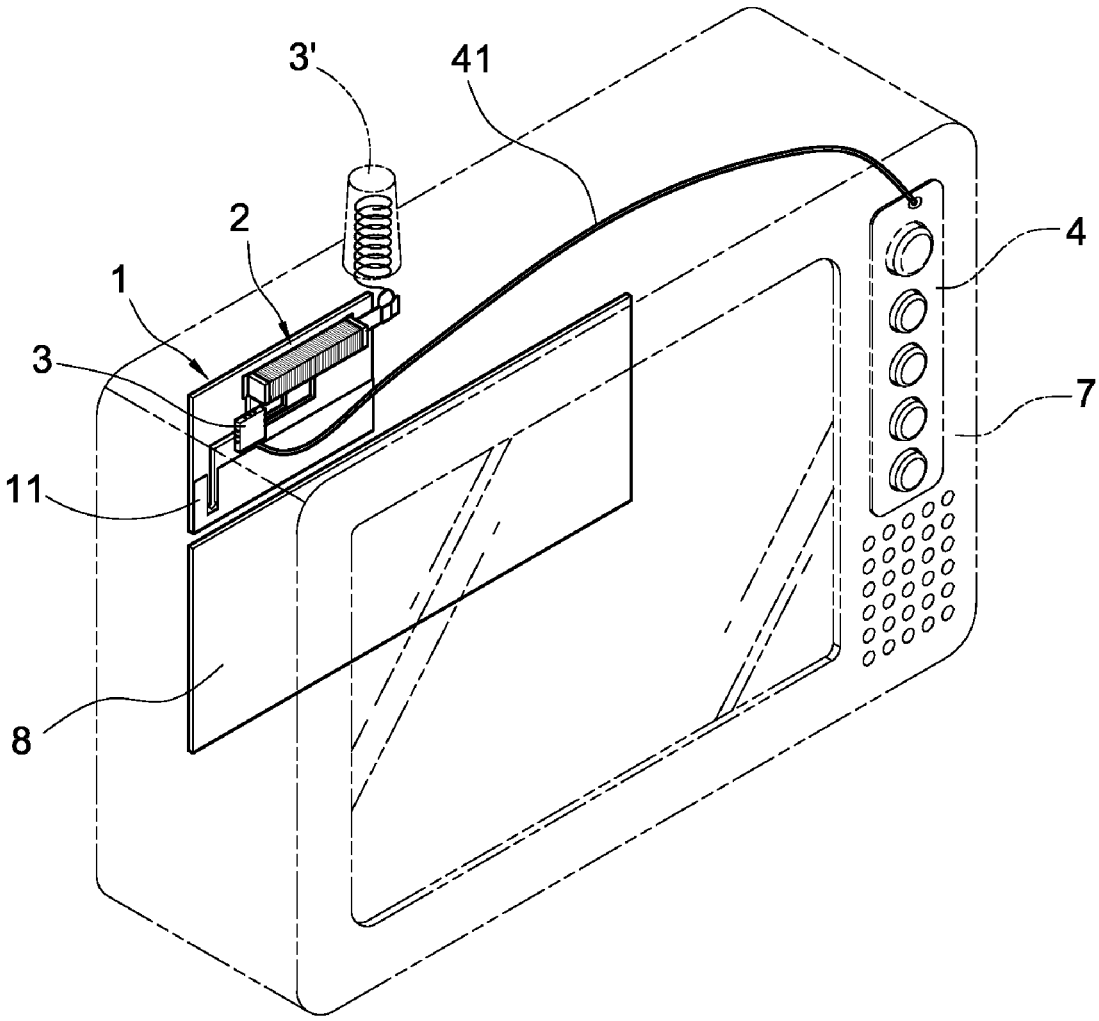
FIG. 15 is a schematic view showing a further embodiment of the present invention.

With reference to FIG. 15, it is a schematic view showing a further embodiment of the present invention. As shown in this figure, when the digital reception antenna is mounted in the digital television 7, an external small-sized antenna unit 3' can be electrically connected to the second electrode 23 of the antenna unit 2, thereby increasing the capacity of receiving the digital TV signals.

What is claimed is:

1. An extremely miniaturized digital TV signal reception antenna, built in a mobile device and controlled by a tuner of the mobile device for automatically switching the range of a bandwidth of received digital TV signals, comprising:

a substrate provided with a plate having a grounding metallic surface and a first clearance surface, a second clearance surface being provided on the same side of the grounding metallic surface for allowing the surface of the substrate to be exposed, the second clearance surface having a metallic microstrip line, the first clearance surface being provided thereon with a plurality of leads and a contact;

an antenna unit electrically connected to the plurality of leads and the contact; and a switch unit having a plurality of control ends, input ends and an output end, the plurality of control ends being electrically connected with a tuner, the input ends being electrically connected with the plurality of leads, the output end being electrically connected with the metallic microstrip line;

wherein the tuner outputs a signal to any one of the control ends of the switch unit when switching channels, the received digital TV signals are input via the input end of the control end and is output to the metallic microstrip line via the output end, the signal is transmitted from the metallic microstrip line to the mobile device and is processed therein.

2. The extremely miniaturized digital TV signal reception antenna according to claim 1, wherein one end of the metallic microstrip line extends to a bottom end of the second clearance surface to form a signal input point.

3. The extremely miniaturized digital TV signal reception antenna according to claim 1, wherein the antenna unit is made into an elongated cubic carrier by a ceramic material having a dielectric constant ($K \geqq 4$).

4. The extremely miniaturized digital TV signal reception antenna according to claim 3, wherein both ends of the carrier are covered with two electrodes, and a helical lead is electrically connected between the two electrodes for covering the surface of the carrier.

5. The extremely miniaturized digital TV signal reception antenna according to claim 1, wherein the switch unit has a plurality of switches therein, signal output pins of the plurality of switches are electrically connected with the output end of the switch unit, and signal input pins of the switches are electrically connected with the input ends of the switch unit.

6. The extremely miniaturized digital TV signal reception antenna according to claim 1, wherein a metallic piece additionally extends from the distal end of the contact of the substrate, thereby increasing the radiation gain.

7. The extremely miniaturized digital TV signal reception antenna according to claim 6, wherein the adjustment of the width or length of the metallic piece allows the radiation efficiency and the impedance match to be adjusted.

8. The extremely miniaturized digital TV signal reception antenna according to claim 1, wherein one of the leads on the substrate is electrically connected with any electrode of the antenna, and the other end of the lead is electrically connected with the metallic microstrip line.

9. The extremely miniaturized digital TV signal reception antenna according to claim 1, wherein the grounding metallic surface, the metallic microstrip line, the leads and a contact on the substrate are provided on a main circuit board of the mobile device, the antenna unit and the switch unit are electrically connected to the main circuit board.

10. The extremely miniaturized digital TV signal reception antenna according to claim 1, wherein an external small-sized antenna unit is electrically connected on the second electrode of the antenna unit.

* * * * *